US005494238A

United States Patent [19]

DiGioia et al.

[11] Patent Number: 5,494,238

[45] Date of Patent: Feb. 27, 1996

[54] SPOOL FOR CORDS OR WIRES

[75] Inventors: Zefferino DiGioia, Bockenheim; Joachim Jantscha, Grünstadt, both of Germany

[73] Assignee: Drahtwarenfabrik Drahtzug Stein GmbH & Co. KG, Drahtzug-Altleiningen, Germany

[21] Appl. No.: 274,899

[22] Filed: Jul. 14, 1994

[51] Int. Cl.[6] ..... B65H 75/20

[52] U.S. Cl. ..... 242/604.1

[58] Field of Search ..... 242/604.1, 604, 242/610.5, 118.1

[56] References Cited

U.S. PATENT DOCUMENTS

| | | | |
|---|---|---|---|
| 1,451,745 | 4/1923 | Sommer | 242/604.1 X |
| 1,526,585 | 2/1925 | Beaujon | 242/604.1 |
| 2,080,355 | 5/1937 | Geer | 242/604.1 |
| 2,217,966 | 10/1940 | Perkins | 242/604.1 X |
| 3,503,569 | 3/1970 | Gildart | 242/604.1 X |
| 3,977,622 | 8/1976 | Fecher | 242/604.1 |
| 4,679,746 | 7/1987 | Compagnucci et al. | 242/604.1 X |

FOREIGN PATENT DOCUMENTS

| | | |
|---|---|---|
| 2814057A1 | 10/1978 | Germany . |
| 2503567C2 | 2/1982 | Germany . |

*Primary Examiner*—John M. Jillions
*Attorney, Agent, or Firm*—Collard & Roe

[57] ABSTRACT

A spool for wires or cords made of metal, plastic or the like, and particularly welding wires. It has single-piece segments, each forming a U-shaped support yoke with a cross bridge and legs. This yoke extends inwardly in radial planes, its free leg ends having the extensions extending in the circumferential direction, and the extensions, joined together, form two parallel wire rings. Two symmetric wire parts are fastened on the radial legs for forming a hub on both sides of the segment, whereby a wire part on both sides of the hub ring segment has a part with a bent extension leg. This part extends the legs against the spool center and reaches up to the spool diameter. In their transition zone into the hub ring segments, the wire parts are connected with each other, whereby the plane established by the connected wire parts coincides with the plane established by the wire rings and the legs.

4 Claims, 4 Drawing Sheets

SPOOL FOR CORDS OR WIRES

BACKGROUND OF THE INVENTION

1. Field of the Invention

The present invention relates to a spool for cords or wires made of metal, plastic or the like, and in particular welding wires. The spool has several one-piece segments, each forming a U-shaped wire yoke extending inwardly in radial planes. The free ends of the legs of this yoke have extensions extending in the circumferential direction and are placed against one another to form two parallel wire rings.

2. The Prior Art

DE 25 03 567 C2 discloses a known spool that can be manufactured simply and inexpensively with a low number of welds to join the segments together. With this spool, the cross bridges between the legs of the U-shaped wire yokes form the support for the wires to be wound, i.e., the winding core is formed by these bridges. When the diameter ratio between the winding core and the central spool hub diameter reach a certain order of magnitude, adapters are used, which permit the spool to be plugged onto a matching running axle.

Furthermore, DE 28 14 057 A1, discloses a spool which is assembled from individual single-piece segments, whereby both the diameter of the winding core and a central spool hub diameter are formed by these segments. However, the drawback of this known spool is that the segments forming the spool require four welding spots for connecting two of such segments. The placement of the welding spots is made difficult by their local position and, therefore, requires more sophisticated welding equipment. Furthermore, the design of the segments results in increased material consumption. Furthermore, this construction is disadvantageous in that it is not suitable for larger spools for stability reasons.

SUMMARY OF THE INVENTION

It is an object of the present invention to overcome the drawbacks of the prior art and to provide an improved spool having a reduced central spool hub diameter which can be manufactured inexpensively and including an adapter that is made out of the same material as is used for the rest of the spool.

According to the invention, this object is achieved in that at least two symmetric wire parts are fastened on the radial legs for forming a hub on both sides of the segments, whereby provision is made for one wire part at each side of a hub ring segment. The wire part extends from the legs toward the center of the spool with a bent extension leg. The wire parts are connected with each other within a transition zone to form hub ring segments, whereby the plane established by the connected wire parts coincides with the plane established by the wire rings and the legs.

According to another embodiment, the segments each have a step (deepening) at the transition end for receiving the associated leg.

In a further embodiment, the ends of the extensions are bent off radially inwardly so that the ends extend parallel with the legs of the segment following in each case. The ends are rigidly connected with said legs, for example by spot welding.

Furthermore, in another embodiment the extensions extend in opposite directions.

The invention has the advantages that by a simple modification of the known spool, it is possible to produce a spool having a central spool hub. Furthermore, this results in a rugged and simple construction, which can be manufactured easily because it is based on a proven design. The spool, moreover, has the added advantage that it is environmentally friendly because it only contains iron wire, so that it is fully recyclable.

BRIEF DESCRIPTION OF THE DRAWINGS

Other objects and features of the present invention will become apparent from the following detailed description considered in connection with the accompanying drawings which discloses the embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
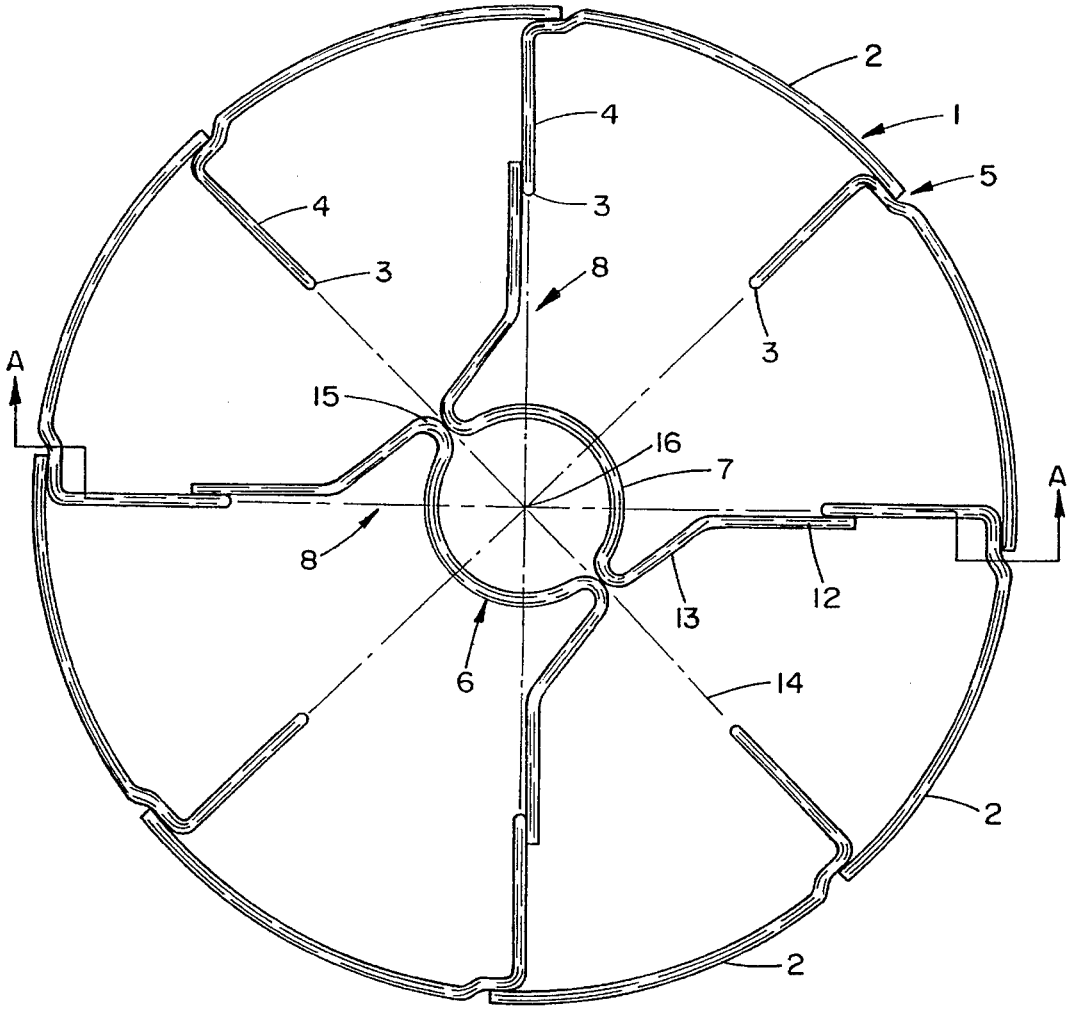
FIG. 1 is a front elevation view of an embodiment of the spool according to the invention.

Turning now in detail to the drawings, FIG. 1 shows segments 1, each formed as a U-shaped wire yoke with a cross bridge 3 and a pair of radially-extending legs 4. The free ends of legs 4 are coupled to curved parallel extensions 2 that form the outer periphery of the spool. Each segment 1 can be produced in one work step in such a way that extensions 2, of each U-shaped wire yoke, are integrally formed with each leg 4. An inwardly pressed recess or depression 5 is formed between each extension 2 and the corresponding leg 4 for receiving the adjacent leg. Cross bridges 3 form the spool winding diameter upon which the wires or cables are wound.

Figure 2:
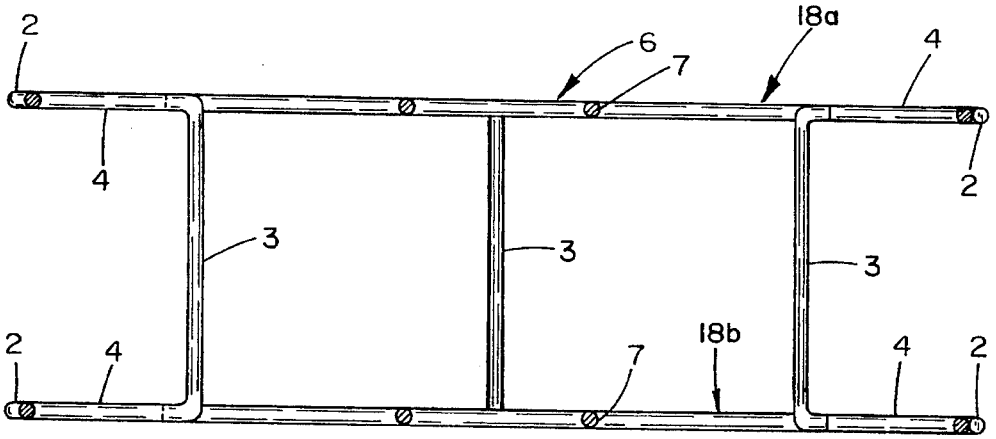
FIG. 2 is a cross-sectional view taken along the line A—A from FIG. 1.

So that the spool can be mounted on a running axle, a hub 6 is formed by two symmetric wire parts 8. Wire parts 8 are mounted on the legs 4 on both sides of the spool. In the embodiment shown, the spool has eight segments 1, with oppositely oriented pairs of legs 4 disposed along common diameters of the circular ring. Wire parts 8 have radially-extending members 12 with laterally angled extension legs 13 that are integrally formed with ring segments 7. Hub ring segments 7 are joined to each other along spool diameter 14. The two wire parts 8 are approximately M-shaped, with members 12 welded on legs 4, and legs 13 welded to each other along their plane of contact on spool diameter 14. Furthermore, the wire parts 8 are fastened in such a way that they do not laterally project from the spool (FIG. 2) and are disposed within the outer spool planes **18*a* and 18*b*. FIG. 1 shows the arrangement of parts 12 on the respective legs 4, and the connection of the wire parts 8 within the transition zone 15. One wire part 8 is inverted on top of the other wire part 8. In this way, the hub 6 is formed by the hub ring segments 7**, i.e., a semicircular curve between the two humps of the M.

Figure 3:
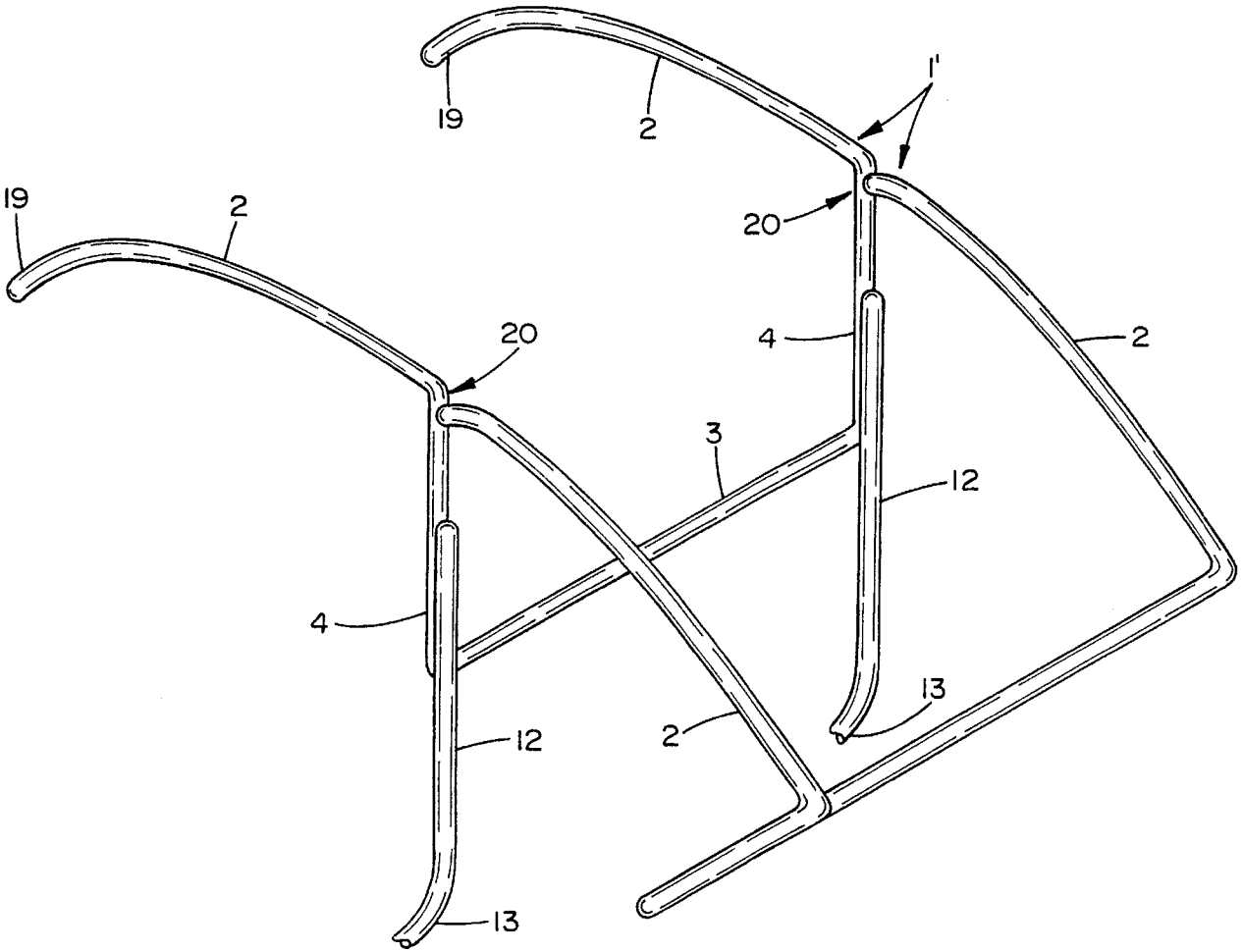
FIG. 3 is a perspective view of two spool segments according to another embodiment of the spool of the invention.

In the second embodiment according to FIG. 3, ends 19 of the extensions 2 are slightly bent inwardly and are butt-joined with legs 4 of the adjacent segment 1'. In all other respects, however, segment 1' is formed similar to segment 1 according to FIGS. 1 and 2.

Figure 4:
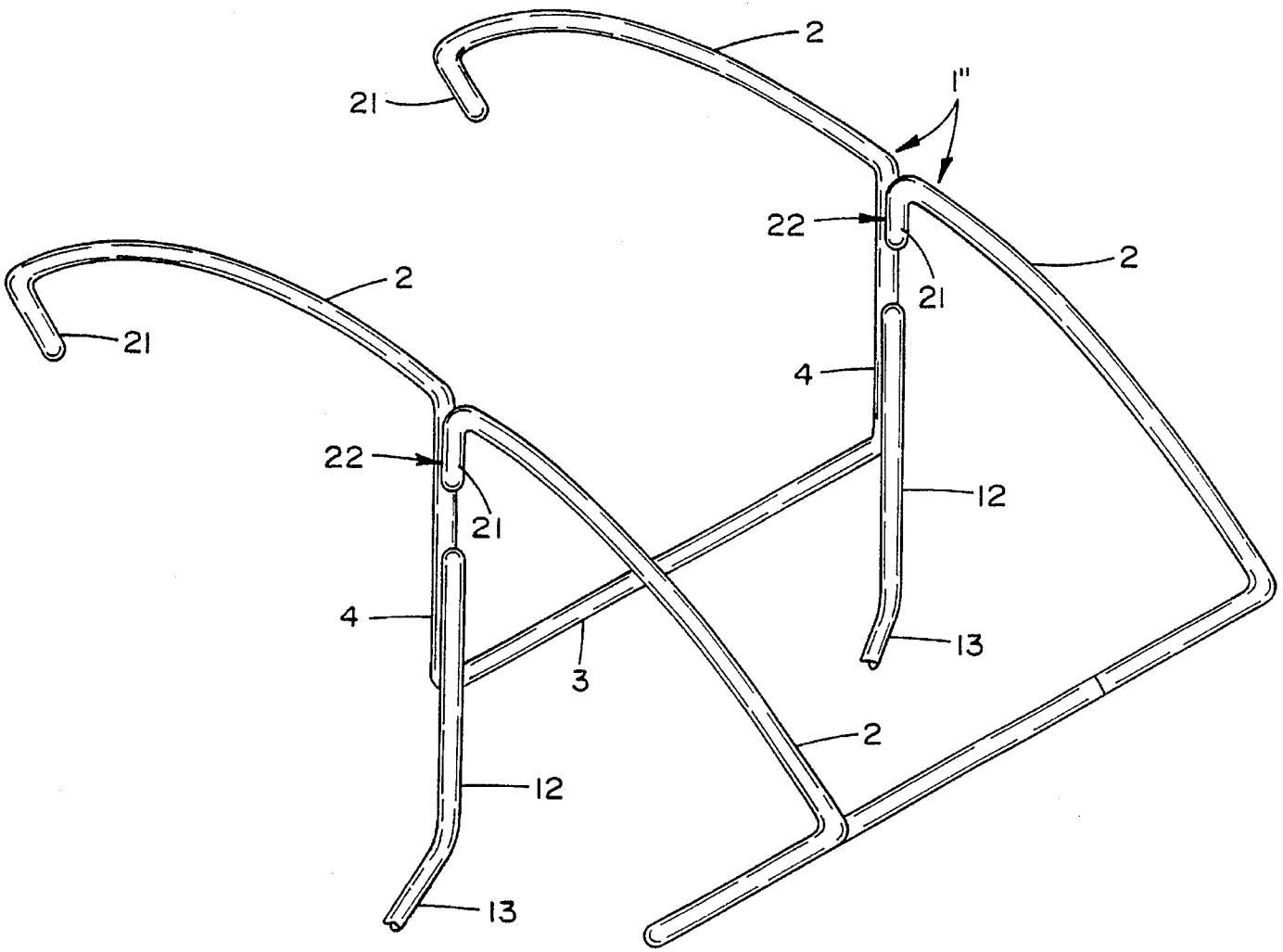
FIG. 4 is a perspective view of two spool segments according to a further embodiment of the invention.

In the third embodiment according to FIG. 4, the ends 21 of the extensions 2 are bent radially inwardly and extend parallel to legs 4 of the adjacent segment 1". A spot weld connection is then made between ends 21 and legs 4 at locations 22. Ends 21 are aligned with radially-extending members 12 on a side of legs 4, for example.

Figure 5:
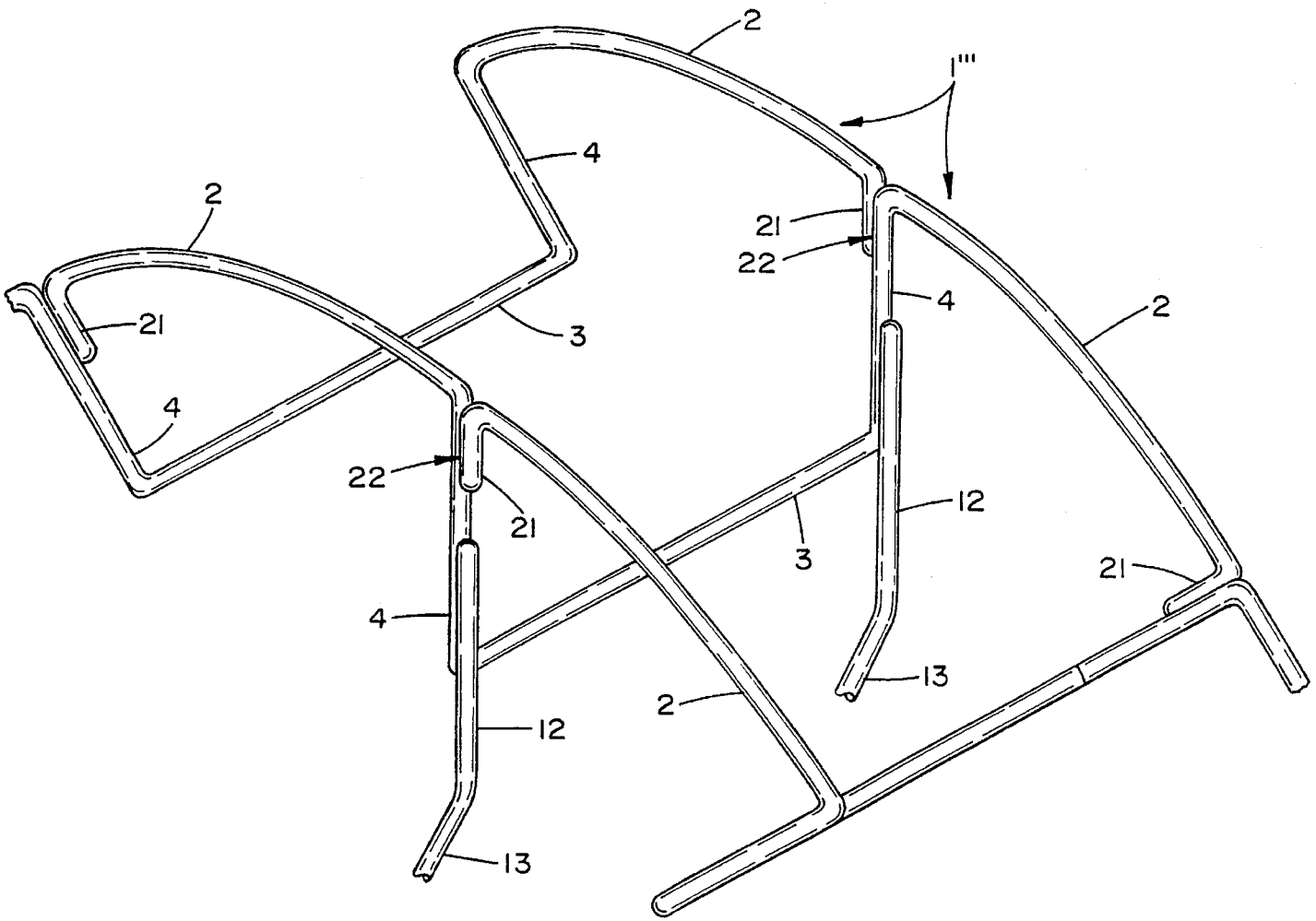
FIG. 5 is a perspective view of two spool segments of yet another embodiment of the spool of the invention.

Finally, the fourth embodiment according to FIG. 5 shows segments 1''' having extensions 2 extend in opposite directions. The connections between adjacent segments 1''' are made according to the embodiment according to FIG. 4.

While several embodiments of the present invention have been shown and described, it is to be understood that many changes and modifications may be made thereunto without departing from the spirit and scope of the invention as defined in the appended claims.

What is claimed is:

1. A spool for wires or cords made of metal, plastic or the like, and in particular welding wires, the spool including a radial dimension, a circumferential dimension, two sides which define two parallel radial planes, the spool comprising:

a plurality of integrally formed segments, each bent into a U-shaped wire yoke having (i) two legs with free ends disposed within the radial planes;

(ii) an extension extending from each of said free ends in a circumferential direction and being joined to an adjacent one of said extensions to form two parallel wire rings;

(iii) a step formed on each extension where it meets said free end, for receiving the adjacent extension;

(iv) a cross bridge extending transverse to the radial dimension between said legs, wherein the wires or cords are wound onto said cross bridges; and at least two symmetric wire parts fastened to said legs for forming a hub on each side of the segments, each wire part having two radially-extending members and a hub ring member disposed between said two radially-extending members, wherein said radially-extending members are connected to alternate ones of eight segments;

said wire parts being connected to each other, where said two radially-extending members meet said hub ring members, said connections being within the two parallel planes that also contain said wire rings and said legs.

2. The spool according to claim 1, wherein said extensions extend in the same circumferential direction.

3. The spool according to claim 1, wherein the spool is made of recyclable iron.

4. The spool according to claim 1, wherein said hub ring members are approximately M-shaped, and each side includes an M-shaped member and an inverted M-shaped member.

* * * * *